US005869931A

United States Patent [19]

Terada

[11] Patent Number: 5,869,931

[45] Date of Patent: Feb. 9, 1999

[54] FLUORESCENT LAMP WITH HEAT RADIATION SHEET MEMBER

[75] Inventor: Toshiyuki Terada, Tokyo, Japan

[73] Assignee: Stanley Electric Co., Ltd., Tokyo, Japan

[21] Appl. No.: 927,602

[22] Filed: Sep. 12, 1997

[30] Foreign Application Priority Data

Feb. 10, 1997 [JP] Japan ..... 9-027035

[51] Int. Cl.[6] ..... H01J 11/00

[52] U.S. Cl. ..... 313/607; 313/594; 313/635

[58] Field of Search ..... 313/485, 488, 313/489, 493, 574, 580, 594–601, 607–635, 355

[56] References Cited

U.S. PATENT DOCUMENTS 5,541,480 7/1996 Renardus et al. ..... 313/635

FOREIGN PATENT DOCUMENTS 5-190150 7/1993 Japan .

*Primary Examiner*—Vip Patel

*Attorney, Agent, or Firm*—Weingarten, Schurgin, Gagnebin & Hayes LLP

[57] ABSTRACT

There is provided an improved fluorescent lamp comprising a tubular glass bulb, an internal electrode provided inside of said tubular glass bulb, a fluorescent layer provided on an inner surface of said tubular glass bulb, an external electrode having an opening portion and provided on an outer surface of said tubular glass bulb, and a heat radiation sheet fitly provided on said tubular glass bulb, in which a temperature rise in the glass bulb caused by heat generated by discharge at the time of lighting is inhibited by the heat radiation function of the heat radiation sheet and a reduction in the illuminance caused thereby can also be inhibited.

4 Claims, 3 Drawing Sheets

FLUORESCENT LAMP WITH HEAT RADIATION SHEET MEMBER

BACKGROUND OF THE INVENTION

1. Field of the Invention

This invention relates to a fluorescent lamp and, more specifically, to a fluorescent lamp comprising an internal electrode provided inside a tubular glass bulb, an external electrode provided on an outer surface of the glass bulb, and a fluorescent layer formed on an inner surface of the glass bulb wherein the inside of the glass bulb is filled with a rare gas and the fluorescent layer is excited by ultraviolet light generated by discharge in the rare gas to emit light.

2. Background Art

FIG. 5 shows a configuration of this type of fluorescent lamp 90 of the prior art, which comprises a tubular glass bulb 91, an internal electrode 92, an external electrode 95, and a fluorescent layer 94. Inside the tubular glass bulb 91 which is sealed at both ends, the internal electrode 92 is provided at the center of the bulb 91 and a rare gas 93 is filled. The fluorescent layer 94 is formed on the inner surface of the glass bulb by suitable means such as coating. The external electrode 95 which also functions as a reflector is provided on the outer surface of the glass bulb 91 by affixing an aluminum foil, for example. Opening portions 94*a* and 95*a* each of which has an opening angle $\alpha$ from the center of the glass bulb 91 are formed in the fluorescent layer 94 and the external electrode 95 at the same position, respectively. Thus, the area of the formed fluorescent layer 94 is outwardly and indirectly covered with the area of the external electrode 95.

When voltage is applied between the internal electrode 92 and the external electrode 95 of the fluorescent lamp 90 configured as described above, discharge occurs between the both electrodes 92 and 95, whereby the fluorescent layer 94 is excited to emit the light which is radiated outward from the opening portions 94*a* and 95*a*. At this point, the light emitted from the fluorescent layer 94 to the glass bulb 91 is reflected by the external electrode 95, returns, passes through the fluorescent layer 94 and is radiated from the opening portions 94*a* and 95*a*.

However, in the fluorescent lamp 90 of the prior art described above, the amount of the emitted light is apt to decrease gradually with the passage of time after the start of lighting. Particularly, in the case of application where the lamp is turned on each time it is used and its use time is short, for example, when it is used as a writing light source for electrophotographic (PPC) printers or a reading light source for facsimiles, nonuniform density of the resulted matter occurs due to a sudden change in the amount of the light during a period of about 1 minute from the start of lighting, thereby deteriorating its printing quality.

SUMMARY OF THE INVENTION

An object of the present invention is to solve the above problems of the prior art and the present invention provides a fluorescent lamp comprising a tubular glass bulb, an internal electrode provided inside of the tubular glass bulb, a fluorescent layer provided on an inner surface of the tubular glass bulb, and an external electrode having an opening portion and provided on an outer surface of the tubular glass bulb, wherein the fluorescent lamp further comprises a heat radiation sheet, the heat radiation sheet is formed from a sheet member having an appropriate heat conductivity and a spring force, the heat radiation sheet has a substantially C-shaped cross section and a length substantially equal to the total length of the glass bulb not to cover the opening portion formed in the external electrode, and the heat radiation sheet is fitted onto the glass bulb by the spring force thereof so as to be fitted to the outer diameter of the glass bulb.

Another object of the present invention is to provide a fluorescent lamp as above, in which the fluorescent lamp further comprises an insulating, heat conductive, and flexible sheet provided between the external electrode and the heat radiation sheet.

Further, another object of the present invention is to provide an improved fluorescent lamp comprising a tubular glass bulb, an internal electrode provided inside of the tubular glass bulb, a fluorescent layer provided on an inner surface of the tubular glass bulb, and an external electrode provided on an outer surface of the tubular glass bulb, wherein the external electrode is formed from a sheet member having an appropriate heat conductivity and a spring force, the external electrode has a substantially C-shaped cross section and a length substantially equal to the total length of the glass bulb, the external electrode has a brightening treated surface in contact with the glass bulb, and the external electrode is fitted onto the glass bulb by the spring force thereof so as to be fitted to the outer diameter of the glass bulb.

In addition, a further object of the present invention is to provide the fluorescent lamp as described before, in which the surface in contact with the glass bulb of the external electrode is treated by the method selected from the group consisting of nickel plating and chromium plating.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

Figure 1:
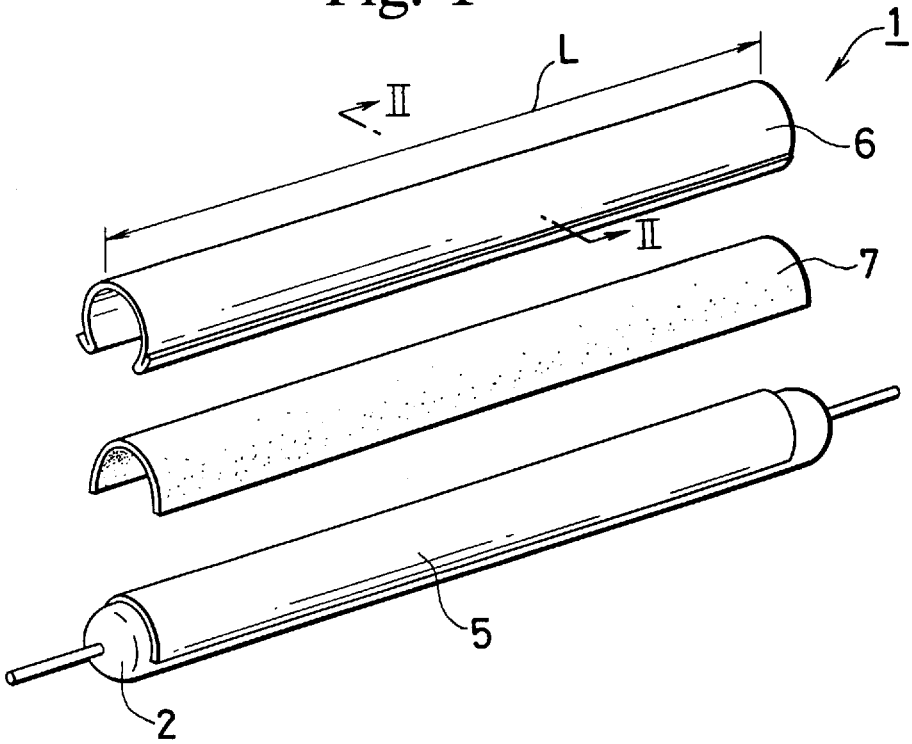
FIG. 1 is a partially exploded perspective view of a fluorescent lamp according to an embodiment of the present invention.
Figure 2:
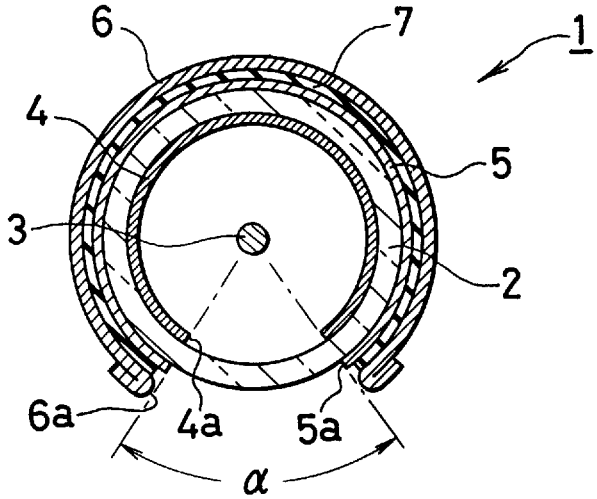
FIG. 2 is a sectional view taken on line A—A of the fluorescent lamp of FIG. 1 when it is assembled.

The present invention is described in detail hereinafter with reference to embodiments shown in the drawings. In FIGS. 1 and 2, reference numeral 1 denotes a fluorescent lamp according to the present invention. This fluorescent lamp 1 comprises a tubular glass bulb 2, an internal electrode 3 provided inside the tubular glass bulb 2, a fluorescent layer 4 having an opening portion 4*a* and formed on the inner surface of the glass bulb 2, and an external electrode 5 having an opening portion 5*a* and provided on the outer surface of the glass bulb 2 like the prior art.

In the present invention, paying attention to the fact that a reduction in the amount of the emitted light after the start of lighting is caused by a drop in the excitation efficiency of the fluorescent layer 4 due to heat generated by discharge, a heat radiation sheet 6 is formed on the outer surface of the glass bulb 2 so as to be in close contact with the glass bulb 2. In consideration of taking out light, the heat radiation sheet 6 is provided as substantially the same form as the external electrode 5 formed on the outer surface of the glass bulb 2.

Since the external electrode 5 also functions as a reflector as explained in the prior art description, the rear surface of the external electrode 5 does not contribute to the illuminance characteristics of the fluorescent lamp 1. Therefore, the heat radiation sheet 6 is formed on the rear surface of the external electrode 5 to enable the heat radiation of the glass bulb 2 without affecting the illuminance characteristics of the fluorescent lamp 1.

Accordingly, in the present invention, the heat radiation sheet 6 is fitted to the outer diameter of the glass bulb 2, has a length L substantially equal to the total length of the glass bulb 2, and is provided not to cover the opening portion 5*a* formed in the external electrode 5. That is, the cross section of the heat radiation sheet 6 perpendicular to the axis of the glass bulb 2 is substantially shaped like a letter C having an opening portion 6*a* as shown in FIG. 2.

Since the opening angle $\alpha$ of the opening portion 5*a* formed in the external electrode 5 is generally 70° to 90°, the heat radiation sheet 6 having substantially the same shape as the external electrode 5 has an inner diameter larger than that of the opening portion 6*a* of the heat radiation sheet 6. In the present invention, the heat radiation sheet 6 is formed from a member having an excellent heat conductivity and a spring force, typically a sheet member of a metal such as phosphor bronze.

When it is to be fitted onto the glass bulb 2, the opening portion 6*a* of the heat radiation sheet 6 is applied to the side surface of the glass bulb 2 and pressed from a rear side of the heat radiation sheet 6. Thereby, the opening portion 6*a* of the heat radiation sheet 6 is expanded and passes over the maximum diameter of the glass bulb 2. After passing over the maximum diameter thereof, the heat radiation sheet 6 returns to its original shape by spring force and is fitted onto the glass bulb 2.

Denoted by 7 in the figures is an insulating sheet formed from an insulating member having an excellent heat conductivity and a flexibility such as silicon rubber. Since the heat radiation sheet 6 is formed from a metal member having conductivity, when it is fitted onto the glass bulb 2 without such an insulating sheet, it is brought into contact with the external electrode 5 and becomes a live part. Thus, if there is no problem when the heat radiation sheet 6 becomes a live part, the insulating sheet 7 can be omitted.

Figure 3:
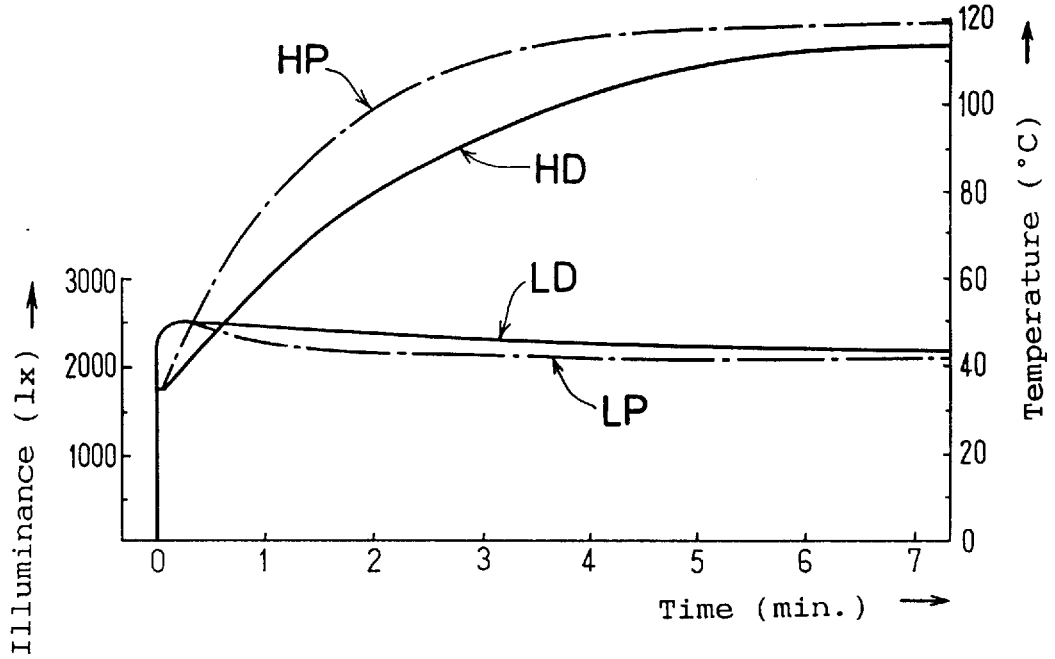
FIG. 3 is a graph showing the changes of temperatures and illuminances of a fluorescent lamp according to the present invention and a fluorescent lamp of the prior art.

FIG. 3 is a graph showing the function and effect of the fluorescent lamp 1 of the present invention in comparison with those of the prior art to make more understandable. A curve denoted by HP in the graph shows a rise in the temperature of the glass bulb 2 after the start of lighting the fluorescent lamp of the prior art and a curve denoted by HD also shows a rise in the temperature of the fluorescent lamp 1 of the present invention.

Furthermore, a curve denoted by LP shows changes in illuminance after the start of lighting the fluorescent lamp of the prior art and a curve denoted by LD also shows changes in illuminance in the fluorescent lamp 1 of the present invention.

When the temperature rising curve HP of the prior art is compared with the temperature rising curve HD of the fluorescent lamp 1 of the present invention, a temperature rise in the fluorescent lamp 1 of the present invention is kept lower markedly during a period of about 5 minutes after the start of lighting than that in the fluorescent lamp of the prior art.

There is produced a difference between the illuminance changing curve LP of the prior art and the illuminance changing curve LD of the fluorescent lamp 1 of the present invention which is substantially proportional to the difference between the above temperature rising curves. As is evident from the figure, the illuminance changing curve LD of the fluorescent lamp 1 of the present invention shows that illuminance decreases linearly along with the passage of time whereas the illuminance changing curve LP of the prior art shows that illuminance sharply drops during a period of about 1 minute after the start of lighting.

Therefore, when the fluorescent lamp of the prior art is used as a reading light source for facsimiles, for example, illuminance changes even if it is used for a relatively short period of time and there is a difference in the optical density of a read image, that is, an image to be transmitted. With the fluorescent lamp 1 of the present invention, the difference can be reduced.

Figure 4:
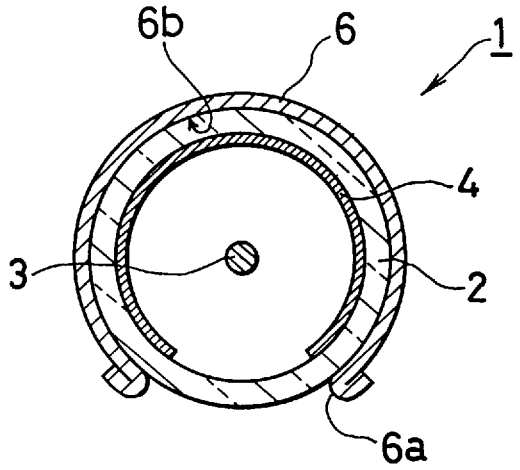
FIG. 4 is a sectional view of key parts of a fluorescent lamp according to another embodiment of the present invention.
Figure 5:
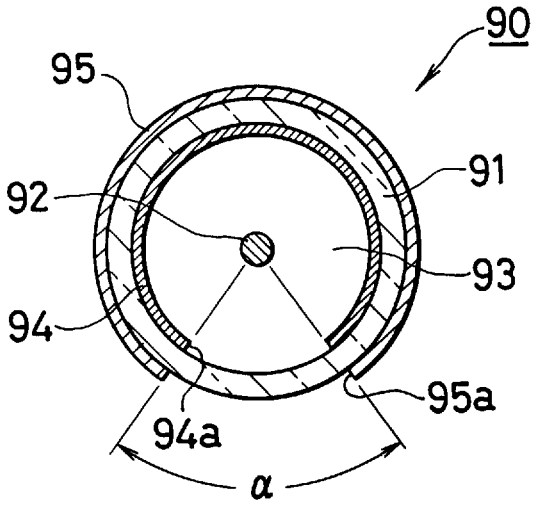
Fig. 5 Prior Art
FIG. 5 is a sectional view of a fluorescent lamp according to the prior art.

FIG. 4 shows another embodiment of the present invention. In the previous embodiment, the heat radiation sheet 6 is fitted onto the glass bulb 2 on which the external electrode 5 is already formed. As described above, since the heat radiation sheet 6 has almost the same shape as the external electrode 5 and is formed from a conductive member in many cases, the heat radiation sheet 6 is substituted for the external electrode 5 in this embodiment.

Since the external electrode 5 also serves as a reflector in this instance, the same function is required for the heat radiation sheet 6 in this embodiment. Therefore, the surface 6*b* in contact with the glass bulb 2 of the heat radiation sheet 6 is subjected to a brightening treatment such as nickel plating or chromium plating in this embodiment.

As described above, since the fluorescent lamp of the present invention is configured such that a heat radiation sheet formed from a sheet member having an appropriate heat conductivity and a spring force and having a substantially C-shaped cross section not to cover the opening portion of the external electrode is fitted onto the glass bulb by the spring force, a temperature rise in the glass bulb caused by heat generated by discharge at the time of lighting is inhibited by the heat radiation function of the heat radiation sheet and a reduction in the illuminance of the fluorescent lamp caused thereby can be also inhibited. Therefore, the present invention provides such an excellent effect that, for example, the quality of a transmitted image is improved without density changes for a short time when the fluorescent lamp is used as a reading light source for facsimiles.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A fluorescent lamp comprising a tubular glass bulb, an internal electrode provided inside of said tubular glass bulb, a fluorescent layer provided on an inner surface of said tubular glass bulb, and an external electrode having an opening portion and provided on an outer surface of said tubular glass bulb, wherein said fluorescent lamp further comprises a heat radiation sheet, said heat radiation sheet being formed from a sheet member having heat conductivity and a spring force, said heat radiation sheet having a substantially C-shaped cross section and a length substantially equal to the total length of the glass bulb not to cover the opening portion formed in the external electrode, said heat radiation sheet being fitted onto the glass bulb by the spring force thereof so as to be fitted to the outer diameter of the glass bulb.

2. The fluorescent lamp according to claim 1, wherein said fluorescent lamp further comprises an insulating, heat conductive, and flexible sheet provided between said external electrode and said heat radiation sheet.

3. A fluorescent lamp comprising a tubular glass bulb, an internal electrode provided inside of said tubular glass bulb, a fluorescent layer provided on an inner surface of said tubular glass bulb, and an external electrode provided on an outer surface of said tubular glass bulb, wherein said external electrode is formed from a sheet member having heat conductivity and a spring force, said external electrode having a substantially C-shaped cross section and a length substantially equal to the total length of the glass bulb, said external electrode having a brightening treated surface in contact with the glass bulb, said external electrode being fitted onto the glass bulb by the spring force thereof so as to be fitted to the outer diameter of the glass bulb.

4. The fluorescent lamp according to claim 3, wherein said surface in contact with the glass bulb of said external electrode is treated by the method selected from the group consisting of nickel plating and chromium plating.

* * * * *

UNITED STATES PATENT AND TRADEMARK OFFICE

CERTIFICATE OF CORRECTION

PATENT NO. : 5,869,931

DATED : February 9, 1999

INVENTOR(S) : Toshiyuki Terada

It is certified that error appears in the above-identified patent and that said Letters Patent is hereby corrected as shown below:

Column 2, line 41, change "A-A" to --II-II--.

Signed and Sealed this

Eighth Day of June, 1999

*Attest:*

Q. TODD DICKINSON

*Attesting Officer*

*Acting Commissioner of Patents and Trademarks*